US010662615B2

(12) United States Patent
Gerber et al.

(10) Patent No.: US 10,662,615 B2
(45) Date of Patent: May 26, 2020

(54) RIPPER ASSEMBLY AND METHOD FOR MANUFACTURING THE RIPPER ASSEMBLY

(71) Applicant: Caterpillar Inc., Deerfield, IL (US)

(72) Inventors: Byron Lynn Gerber, Roanoke, IL (US); Kelly Ann Scholz, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 157 days.

(21) Appl. No.: 16/028,581

(22) Filed: Jul. 6, 2018

(65) Prior Publication Data

US 2020/0011027 A1 Jan. 9, 2020

(51) Int. Cl.
*E02F 9/08* (2006.01)
*E02F 5/32* (2006.01)
*E02F 3/76* (2006.01)

(52) U.S. Cl.
CPC ..... *E02F 9/0816* (2013.01); *E02F 5/32* (2013.01); *E02F 3/7604* (2013.01)

(58) Field of Classification Search
CPC ..... E02F 9/0816; E02F 5/32; E02F 3/7604; A01B 35/10; A01B 35/14; A01B 35/20; A01B 35/32; A01B 49/04; A01B 76/00
See application file for complete search history.

(56) References Cited

U.S. PATENT DOCUMENTS 3,002,574 A * 10/1961 Padrick ..... A01B 15/025 172/699
4,679,857 A 7/1987 Roussin et al.
9,702,111 B2 * 7/2017 Sokoloski ..... E02F 3/961
2005/0198803 A1 9/2005 Moriya et al.
2006/0047587 A1 3/2006 Desai et al.
2014/0005816 A1 1/2014 Nonaka et al.

FOREIGN PATENT DOCUMENTS

JP 2004131947 4/2004

* cited by examiner

*Primary Examiner* — Faye M Fleming

(57) ABSTRACT

A ripper assembly for a machine includes a primary carriage, a secondary carriage pivotally coupled to the primary carriage. The primary carriage is formed from a winged support structure having a pair of opposing sides and a pair of pivot arms welded onto corresponding opposing sides of the winged support structure. The secondary carriage includes a mid-portion and a pair of intermediary portions welded to ends of the mid-portion to form a single ripper mounting assembly. Additionally, or optionally, the secondary carriage could include a pair of end portions that could be welded onto distal ends of the intermediary portions for forming the ripper assembly to a multiple ripper mounting configuration.

18 Claims, 13 Drawing Sheets

RIPPER ASSEMBLY AND METHOD FOR MANUFACTURING THE RIPPER ASSEMBLY

TECHNICAL FIELD

The present disclosure relates to a ripper assembly for mounting at least one ripper to a machine. More particularly, the present disclosure relates to a method for manufacturing a ripper assembly that can be used to mount at least one ripper to a machine.

BACKGROUND

Typically, ripper mounting arrangements for mounting rippers onto machines are made using weldments that have been formed from multiple sections of metal being joined together at a metal working facility. In some cases, these ripper mounting arrangements may be configured for use in mounting a single ripper. In other cases, these ripper mounting arrangements may be configured for use in mounting multiple rippers. However, when individual sections are fabricated and joined to form the ripper mounting arrangement, or at least a portion thereof, a number of process steps carried out, for example, zones between individual sections that require welds may be less than optimum to achieve the best possible cost effectiveness in respect of value chain management at the metal working facility for the produced ripper mounting arrangements.

In addition, owing to design constraints and other considerations, if the ripper mounting arrangement for mounting a single ripper and the ripper mounting arrangement for mounting multiple rippers have different configurations, the metal working facility may require separate process lines for producing each type of ripper mounting arrangement i.e., single ripper mounting arrangement or multiple ripper mounting arrangement. These separate process lines could, in turn, lower the cost effectiveness of the material working facility in producing the different configurations of the ripper mounting arrangement over the separate process lines.

Hence, there is a need for a ripper assembly and a method for manufacturing the same while overcoming the aforementioned drawbacks.

SUMMARY OF THE DISCLOSURE

In an aspect of this disclosure, a ripper assembly for a machine includes a primary carriage, and a secondary carriage. The primary carriage is formed using a pair of pivot arms disposed on either side of a mid-plane. Each pivot arm has a fore portion configured to pivotally couple with a frame of a machine and an aft portion defining a mounting hole therein. The secondary carriage has a mid-portion, and a pair of intermediary portions welded to ends of the mid-portion. Each intermediary portion is formed using a pair of winged pivot brackets having upper portions and lower portions. The secondary carriage is coupled to the frame by pivotally coupling the upper portion of at least one winged pivot bracket from each intermediary portion with the frame and to the primary carriage by pivotally coupling the lower portion of at least one winged pivot bracket from each intermediary portion with the mounting hole located at the aft portion of the corresponding pivot arm.

In another aspect of the present disclosure, a method for manufacturing a ripper assembly includes forming a primary carriage using a pair of pivot arms disposed on either side of a mid-plane. Each pivot arm has a fore portion configured to pivotally couple with a frame of a machine and an aft portion defining a mounting hole therein. The method further includes forming a secondary carriage having a mid-portion, and a pair of intermediary portions welded to ends of the mid-portion. Each intermediary portion is formed using a pair of winged pivot brackets having upper portions and lower portions. The method further includes coupling the secondary carriage to the frame by pivotally coupling the upper portion of at least one winged pivot bracket from each intermediary portion with the frame and to the primary carriage by pivotally coupling the lower portion of at least one winged pivot bracket from each intermediary portion with the mounting hole located at the aft portion of the corresponding pivot arm.

Other features and aspects of this disclosure will be apparent from the following description and the accompanying drawings.

DETAILED DESCRIPTION

Wherever possible, the same reference numbers will be used throughout the drawings to refer to same or like parts. Moreover, references to various elements described herein are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

The present disclosure relates to a ripper assembly for mounting at least one ripper to a machine. More particularly, the present disclosure relates to a method for manufacturing a ripper assembly that can be used to mount at least one ripper to a machine.

Figure 1:
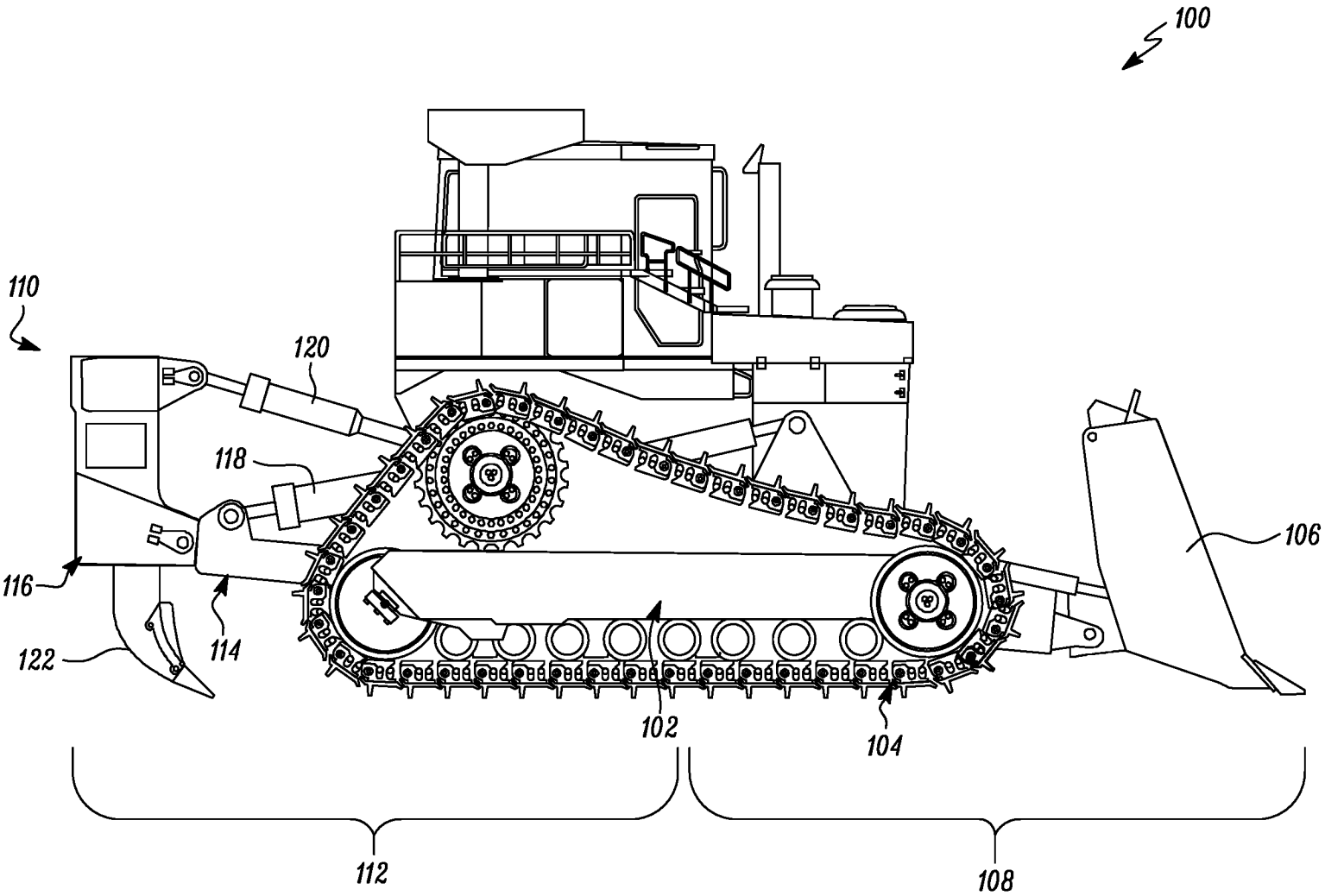
FIG. 1 is a side view of an exemplary machine having a ripper assembly, in accordance with embodiments of the present disclosure.

FIG. 1 depicts a machine 100 that is exemplarily embodied in the form of a track type tractor. Although a track type tractor is depicted in the view of FIG. 1, in other embodiments, other types of machines known to persons skilled in the art may be used in lieu of the track type tractor disclosed herein. Therefore, it may be noted that a type of machine used is merely exemplary in nature and hence, non-limiting of this disclosure.

As shown, the machine 100 includes a frame 102. Also, the machine 100 includes a pair of ground engaging members 104, for e.g., tracks rotatably supported on the frame 102, of which, only one ground engaging member 104 is visible in the side view of FIG. 1. The tracks disclosed herein are merely exemplary in nature, and hence, non-limiting of this disclosure. In other embodiments, other types of ground engaging members, for example, wheels could be implemented in place of the tracks disclosed herein.

The machine 100 may include a work tool 106, for example, a blade disposed at a front portion 108 of the machine 100. This work tool 106 would be pivotally connected to the frame 102 in order to allow for one or more functions, for example, pushing associated with the work tool 106 to be operatively performed by the machine 100.

Figure 2:
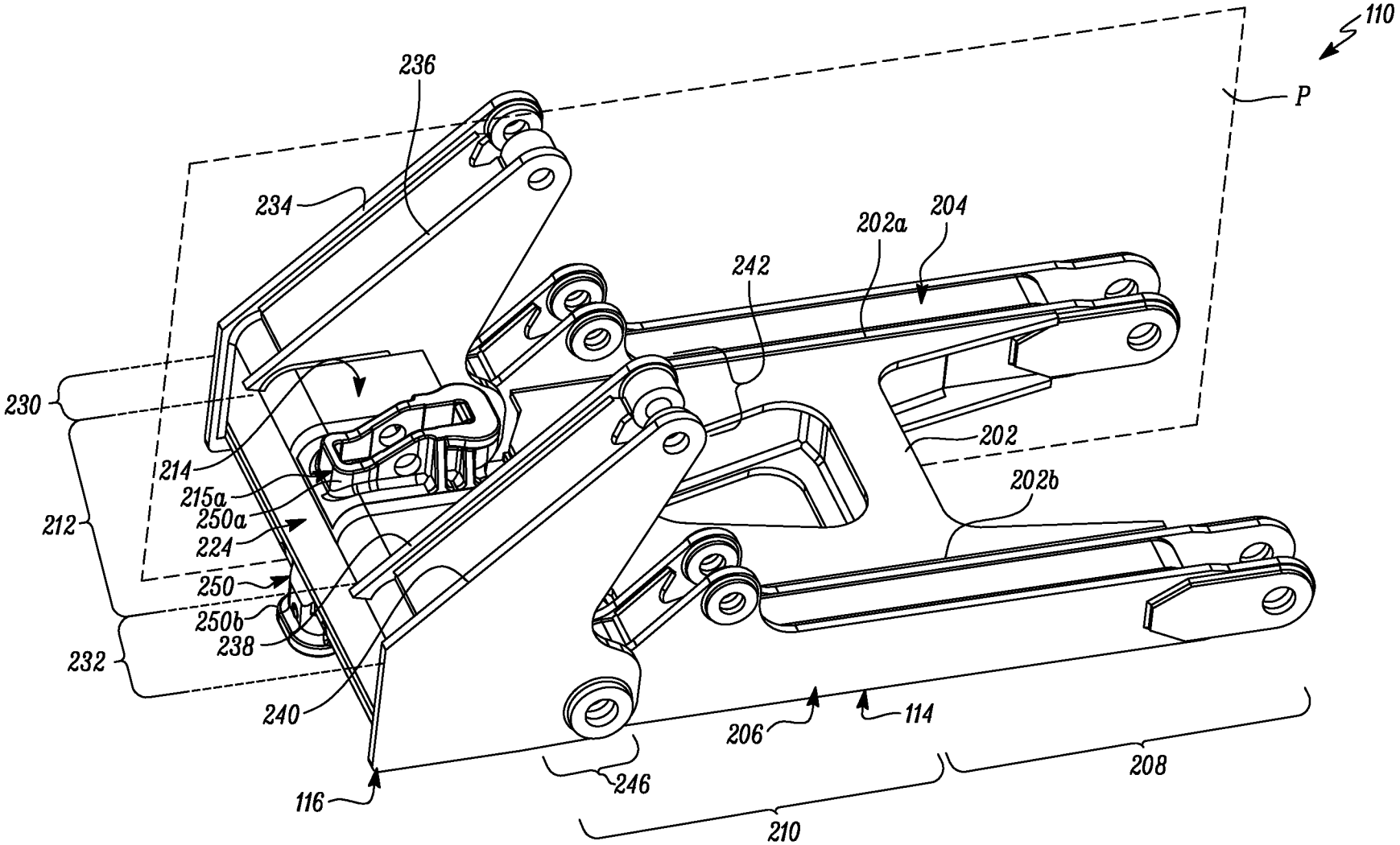
FIG. 2 is a rear perspective view of the ripper assembly from FIG. 1 showing a primary carriage and a secondary carriage that is configured for use in mounting a single ripper in accordance with embodiments of the present disclosure.

Referring to FIGS. 1 and 2, the machine 100 also includes a ripper assembly 110 disposed at a rear portion 112 of the machine 100. The ripper assembly 110 includes a primary carriage 114 and a secondary carriage 116. The primary carriage 114 would be pivotally connected to the frame 102 while the secondary carriage 116 would be pivotally connected to the primary carriage 114 and the frame 102. As best shown in FIG. 1, the machine would also include a pair of lift actuators 118 and a pair of tilt actuators 120, of which, only one lift actuator 118 and one tilt actuator 120 is visible in the side view of FIG. 1. The lift actuator 118 would be connected between the frame 102 and the secondary carriage 116 while the tilt actuator 120 could be connected between the frame 102 and the primary carriage 114.

In operation, the lift actuator 118 would pivotally move and hence, raise or lower the primary carriage 114 in relation to the frame 102. Movement of the primary carriage 114 in relation to the frame 102 also causes a pivotal movement of the secondary carriage 116 in unison with the primary carriage 114 thereby facilitating the primary carriage 114 to be raised or lowered in relation to the frame 102. In addition, the tilt actuator 120 could be operated to rotate the secondary carriage 116, and hence, tilt a position of a ripper 122, that is mounted to the secondary carriage 116 as shown in the view of FIG. 1, in relation to the primary carriage 114. Using operator commands, the lift and tilt actuators 118, 120 can be operated to execute a combination of movements of the ripper 122.

Figure 3A:
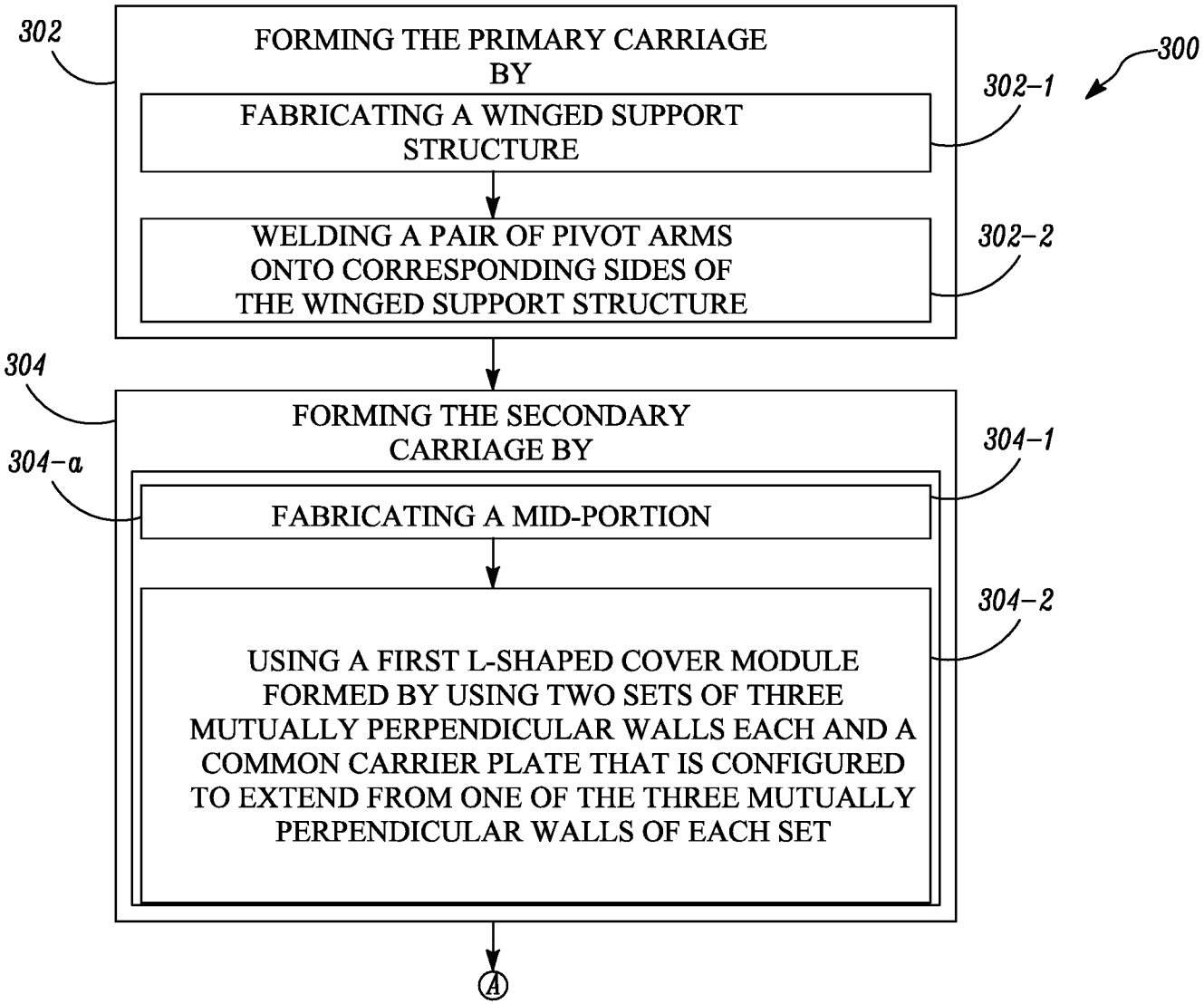
FIG. 3 is a flowchart of a method for manufacturing the ripper assembly of FIG. 2 in accordance with embodiments of the present disclosure.
Figure 3B:
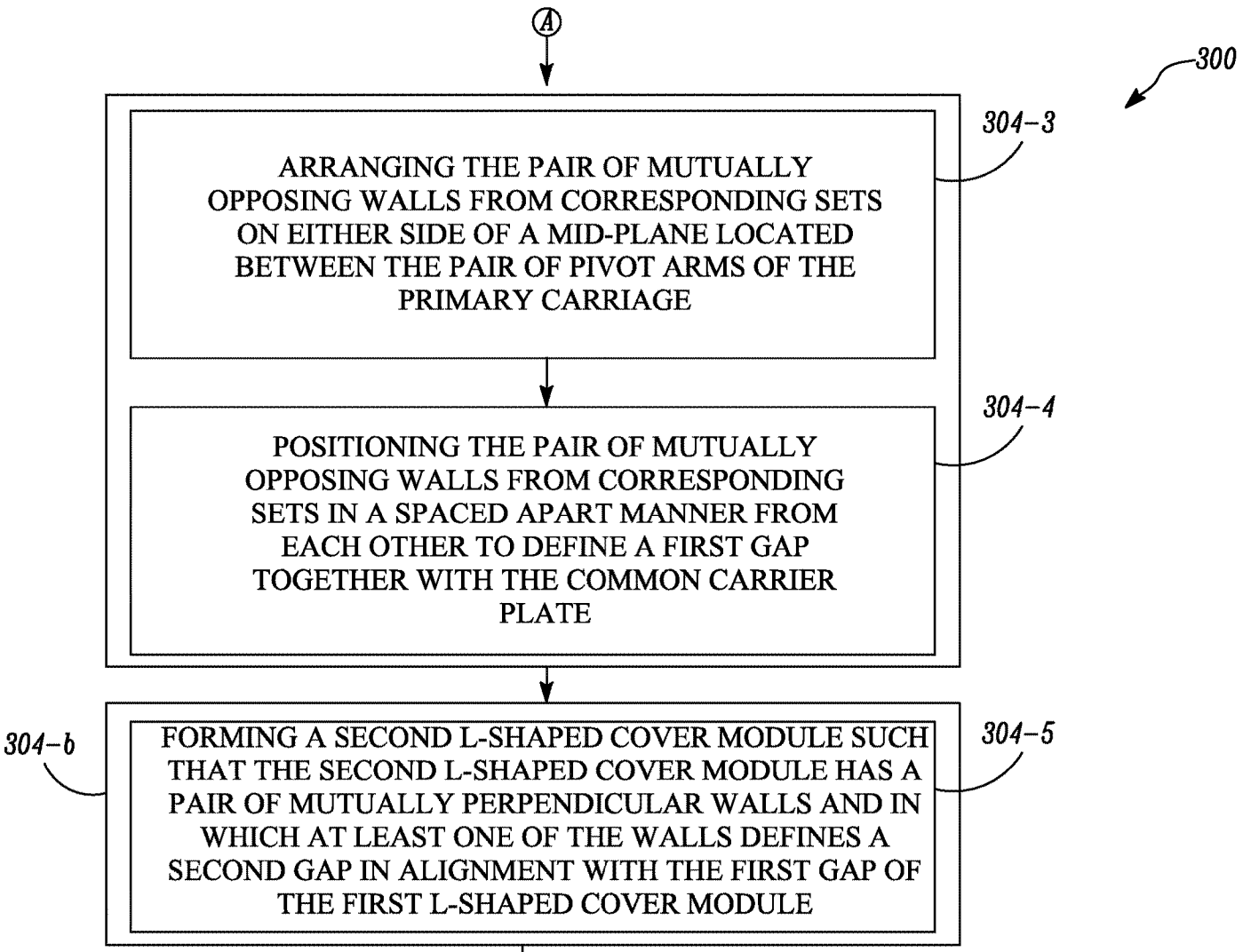
Figure 3C:
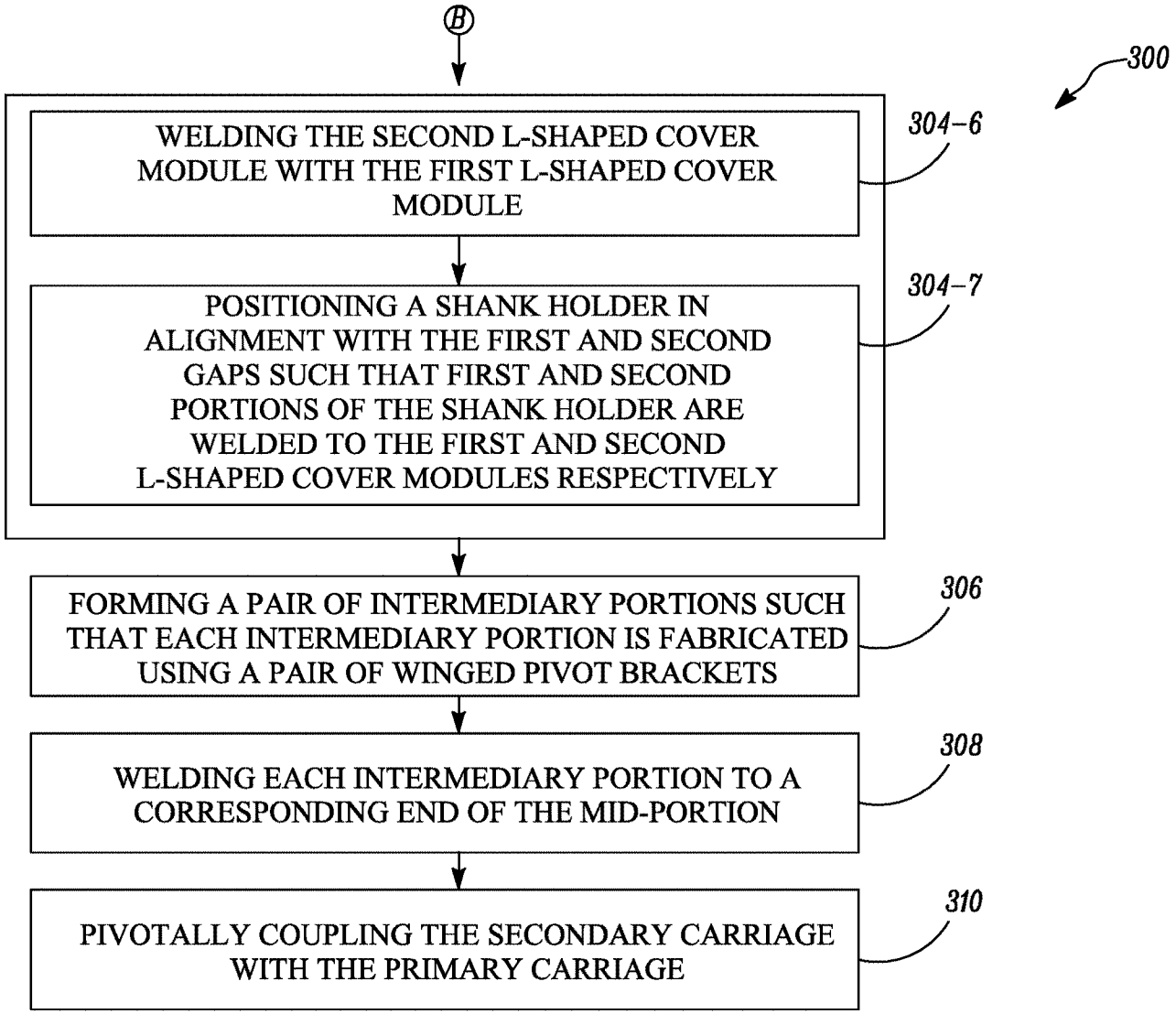

FIG. 3 depicts a method 300 for manufacturing the ripper assembly 110. Explanation to steps 302-322 of the method 300 will be made in conjunction with reference to FIG. 2 and FIGS. 4 to 9.

Figure 4:
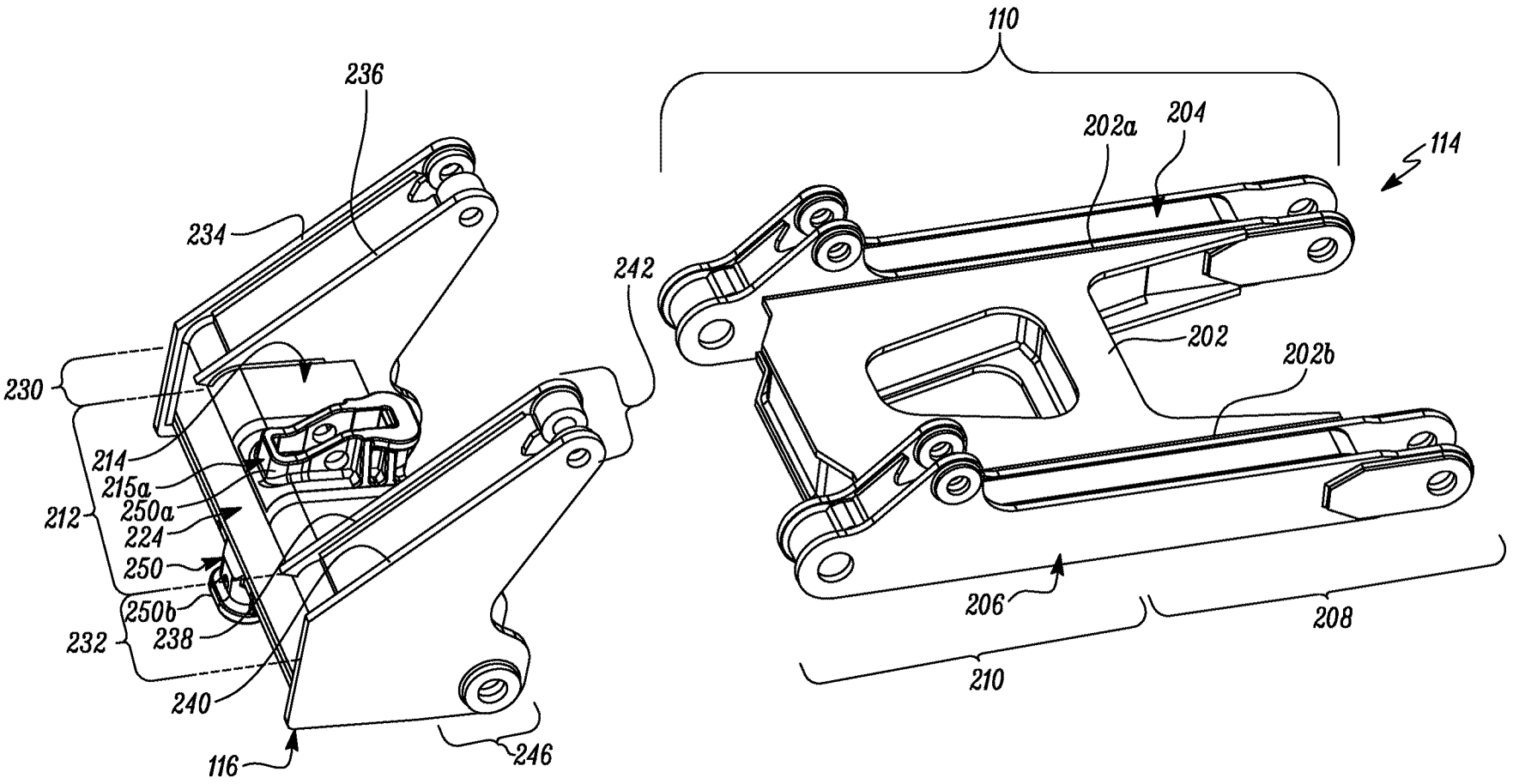
FIG. 4 is a rear exploded view of the ripper assembly in accordance with embodiments of the present disclosure.
Figure 5:
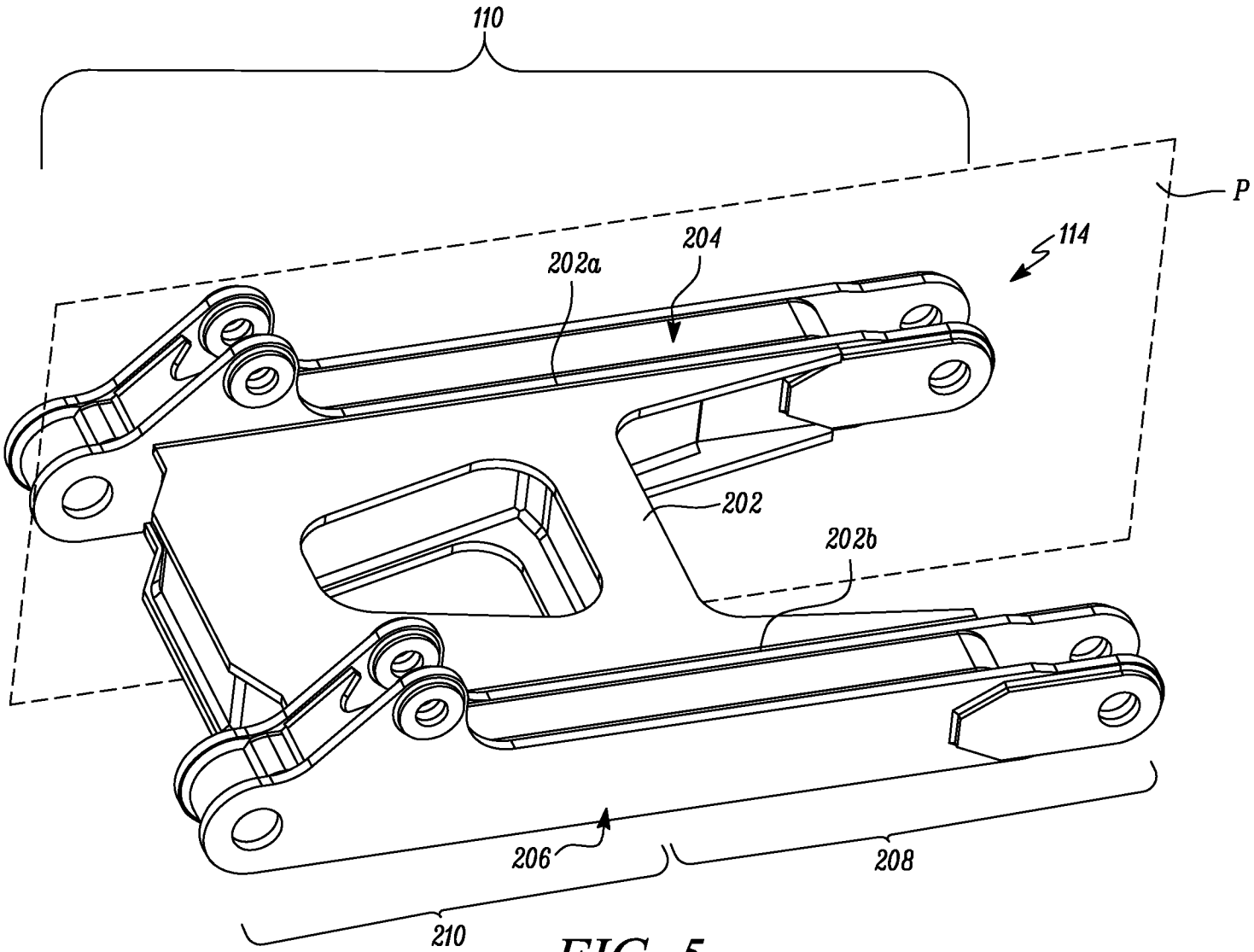
FIG. 5 is a zoomed-in rear perspective view of the primary carriage in accordance with embodiments of the present disclosure.
Figure 6:
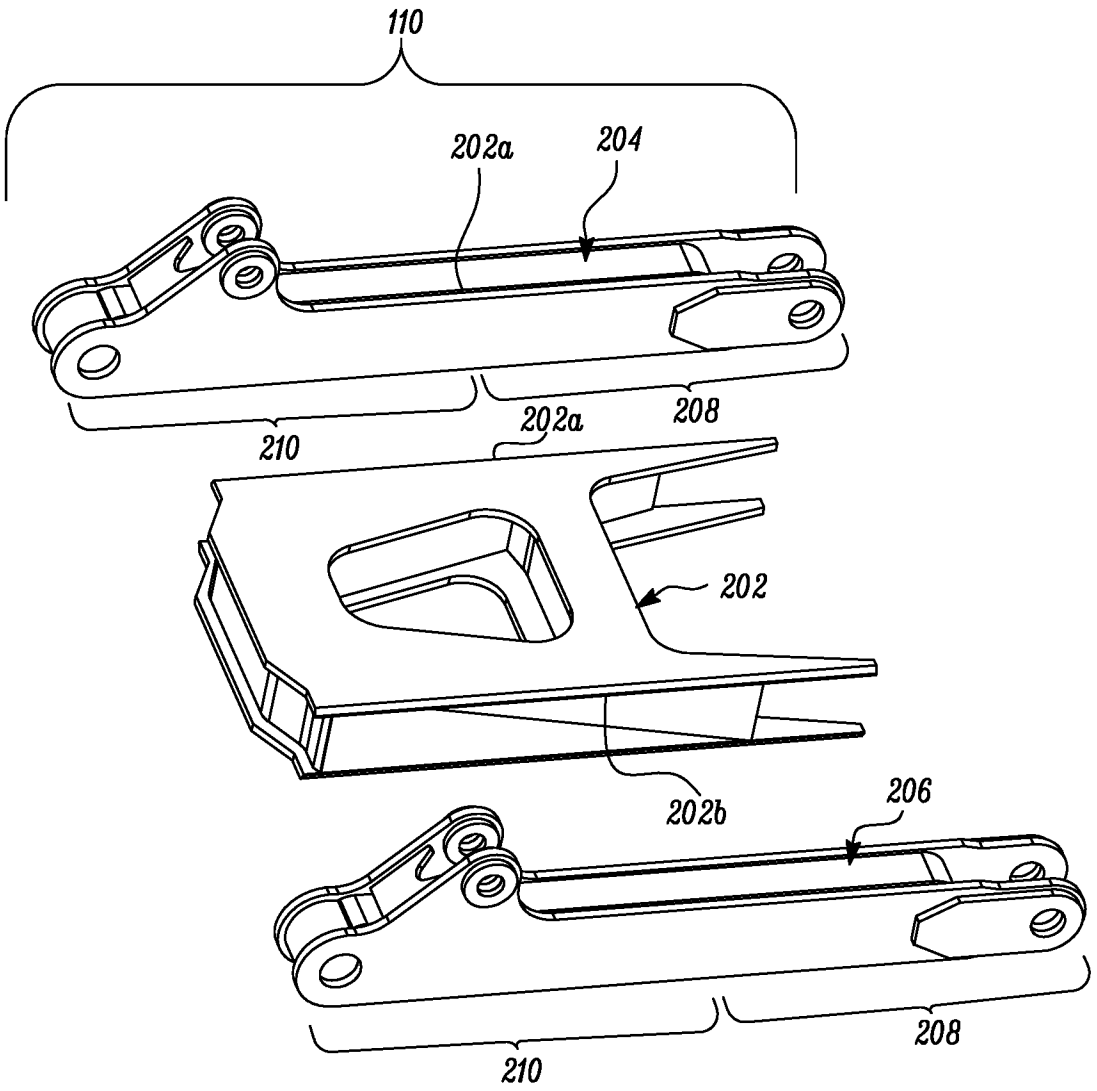
FIG. 6 is an exploded rear perspective view of the primary carriage in accordance with embodiments of the present disclosure.

Referring to FIG. 3, at step 302, the method 300 includes forming the primary carriage 114 which, as shown at step 302-1 is done, at least in part, by fabricating a winged support structure 202 as shown best in the view of FIG. 6. Referring to step 302-2, the method 300 includes welding a pair of pivot arms 204, 206 onto corresponding sides 202*a*, 202*b* of the winged support structure 202 as shown best in the view of FIG. 6. Referring to FIGS. 1 and 2, and as best shown in FIGS. 4 to 6, each pivot arm 204, 206 has a fore portion 208 and an aft portion 210 in which the fore portion 208 of each pivot arm 204, 206 would be configured to pivotally couple with the frame 102 of the machine.

At step 304, the method 300 further includes forming the secondary carriage 116 which, as shown at step 304-1 of block 304-*a* is done, at least in part, by fabricating a mid-portion 212. At step 304-2, the method 300 includes using a first L-shaped cover module 214 that, referring to FIG. 7 and as shown best in FIG. 8, is formed by using two sets of three mutually perpendicular walls 216, 218, 220 each and a common carrier plate 222 that is configured to extend from one of the three mutually perpendicular walls 216, 218, 220 of each set. As shown best in the illustrated embodiment of FIG. 8, the common carrier plate 222 is formed from one of the walls 218 from corresponding sets of mutually perpendicular walls 216, 218, 220.

At step 304-3, the method 300 includes arranging the pair of mutually opposing walls 220 from corresponding sets on either side of a mid-plane P that, referring to FIG. 2 and as shown best in the view of FIG. 8, is located between the pair of pivot arms 204, 206 of the primary carriage 114.

Referring again to FIG. 3, at step 304-4, the method 300 also includes positioning the pair of mutually opposing walls 220 from corresponding sets in a spaced apart manner from each other to define a first gap $G_1$ together with the common carrier plate 222 as shown best in the view of FIG. 8.

Figure 7:
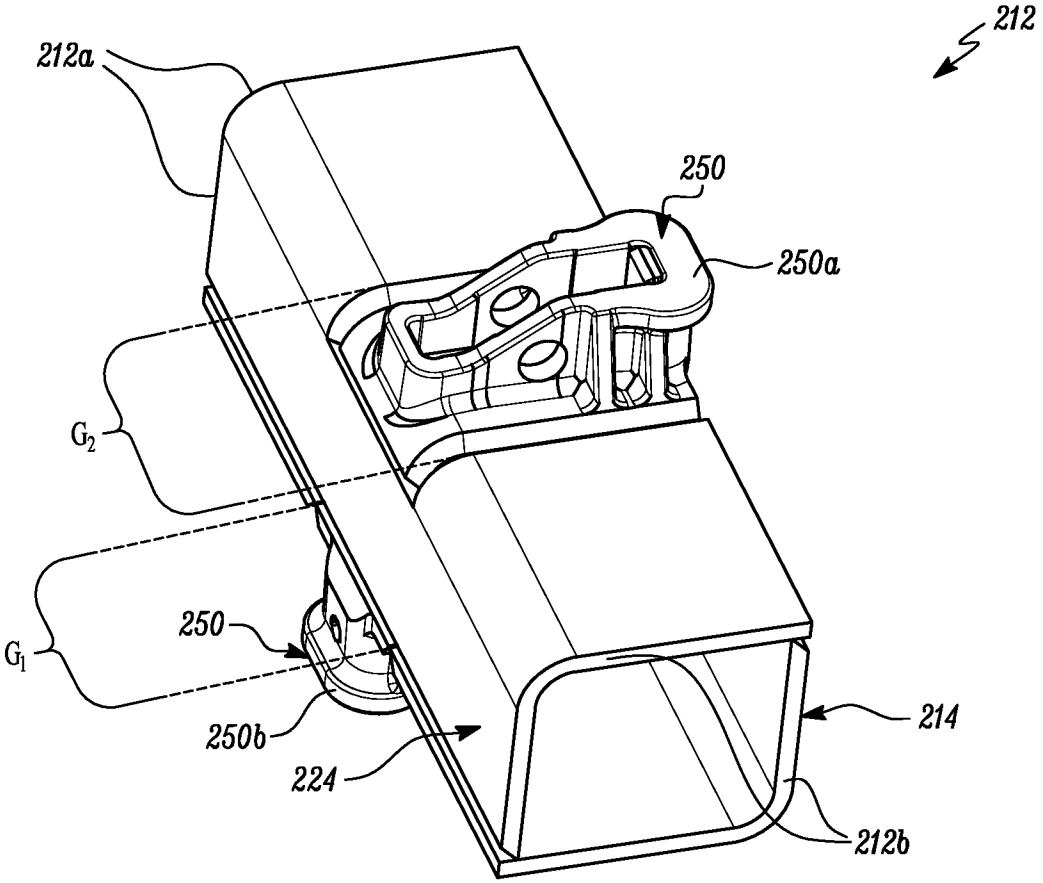
FIG. 7 is a rear perspective view of a mid-portion of the secondary carriage in accordance with embodiments of the present disclosure.
Figure 8:
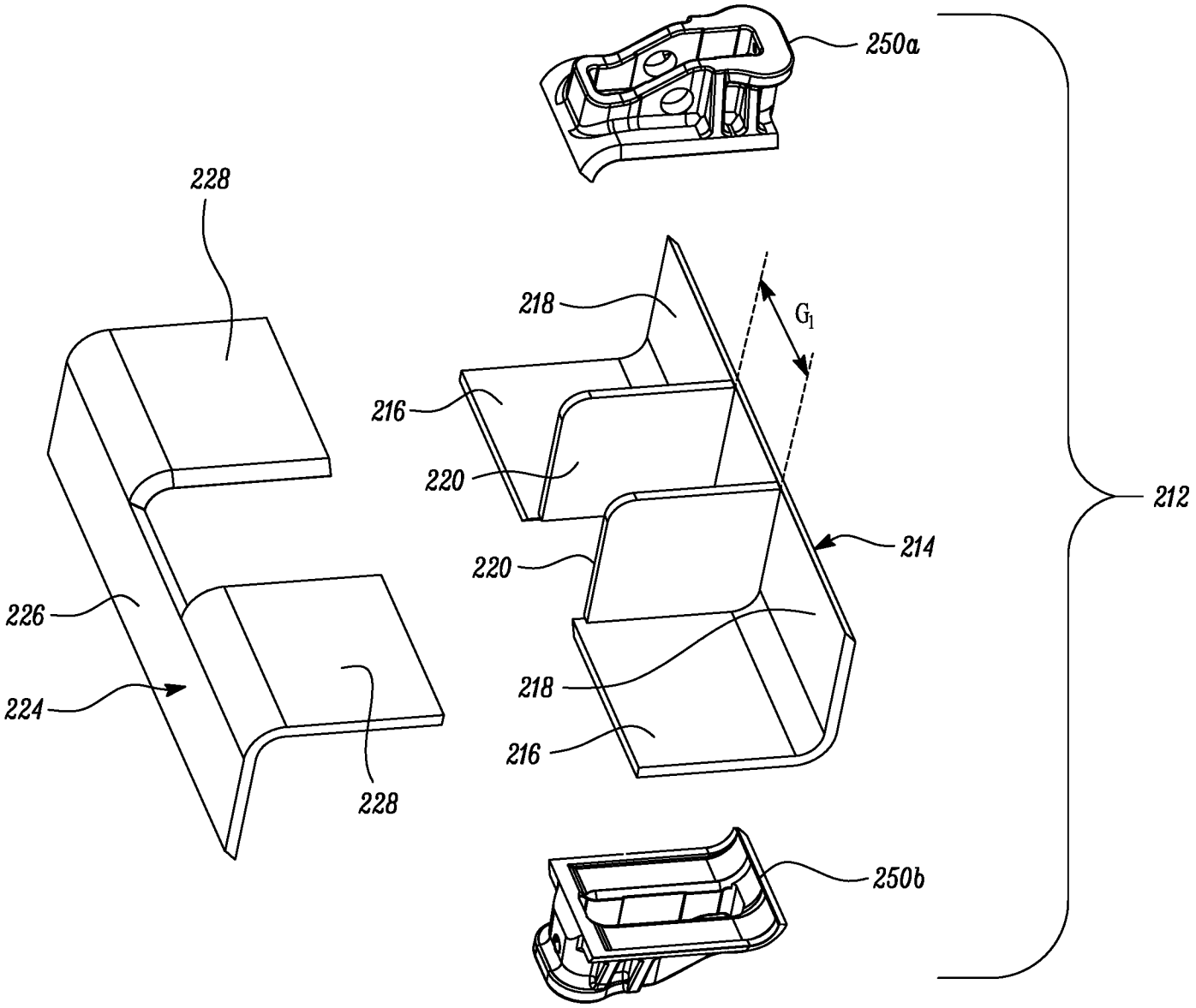
FIG. 8 is an exploded rear perspective view of the mid-portion of the secondary carriage in accordance with embodiments of the present disclosure.

At step 304-5 of block 304-*b*, the method 300 further includes forming a second L-shaped cover module 224 such that, as shown in the view of FIG. 8, the second L-shaped cover module 224 has a pair of mutually perpendicular walls 226, 228 and in which, as shown best in the view of FIG. 7, at least one of the walls i.e., the wall 228 and a portion of the wall 226 defines a second gap $G_2$ in alignment with the first gap $G_1$ of the first L-shaped cover module 214.

Referring to FIG. 3, at step 304-6 of block 304-*b*, the method 300 then includes welding the second L-shaped cover module 224 with the first L-shaped cover module 214 as shown in the view of FIG. 8.

Moreover, at step 304-7 of block 304-*b*, the method 300 then includes positioning a shank holder 250 in alignment with the first and second gaps $G_1$, $G_2$, as shown best in the view of FIG. 8, such that first and second portions 250*a*, 250*b* of the shank holder 250 are, as shown best in the view of FIG. 7, welded to the first and second L-shaped cover modules 214, 224 respectively.

Figure 9B:
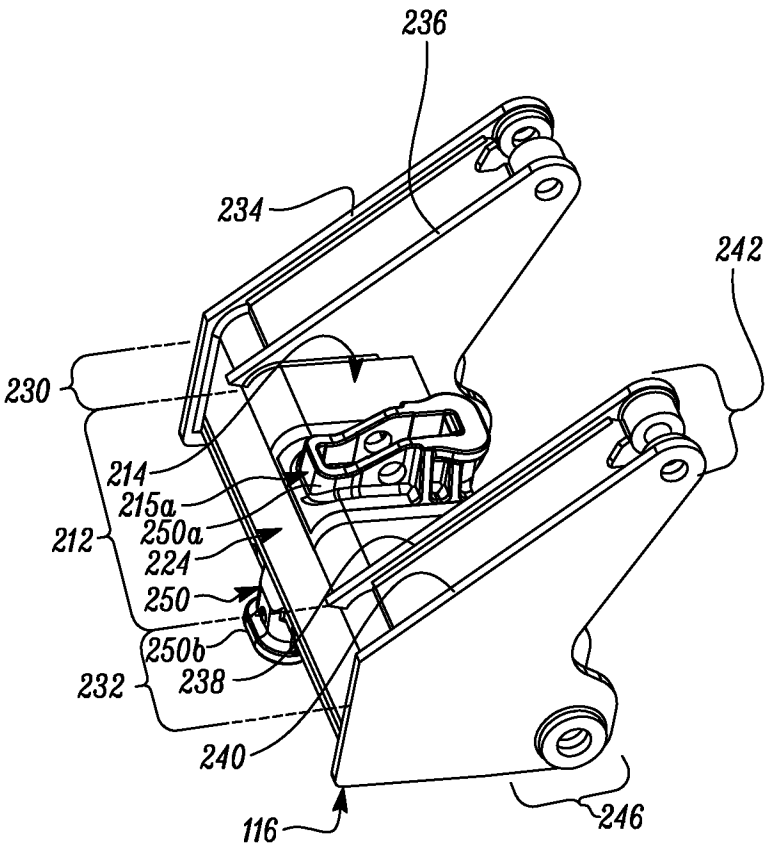
FIGS. 9*a* and 9*b* are exploded and assembled views of the secondary carriage showing a pair of intermediary portions in accordance with embodiments of the present disclosure.
Figure 9A:
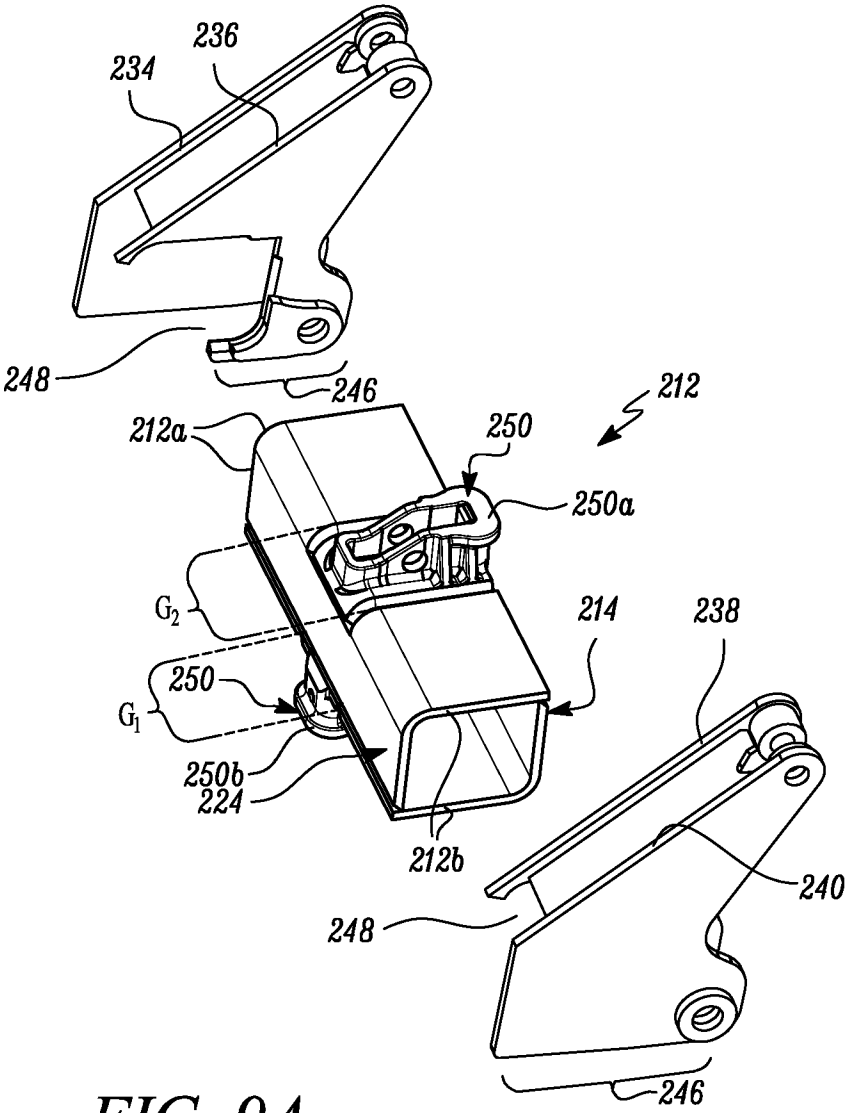

Further, at step 306, the method 300 further includes forming a pair of intermediary portions 230, 232 such that each intermediary portion 230, 232 is fabricated using a pair of winged pivot brackets 234, 236, and 238, 240 respectively as shown best in the view of FIGS. 9*a* and 9*b*. Each winged pivot bracket 234, 236, 238, 240 has upper portions 242 and lower portions 246 for pivotally coupling with the frame 102 and the aft portion 210 of the corresponding pivot arm 204, 206 respectively.

At step 308, the method 300 then includes welding the intermediary portions 230, 232 to corresponding ends 212*a*, 212*b* of the mid-portion 212 that, referring to FIG. 9*a* is shown best in the view of FIG. 9*b*. In an embodiment herein, proximal winged pivot brackets 236, 238 from the pair of intermediary portions 230, 232 define a cut-out 248 that corresponds to a cross-section of the first and second L-shaped cover modules 214, 224.

Thereafter, at step 310, the method 300 includes pivotally coupling the secondary carriage 116 with the primary carriage 114 that, referring to FIG. 2 is shown best in the view of FIG. 4.

Figure 10B:
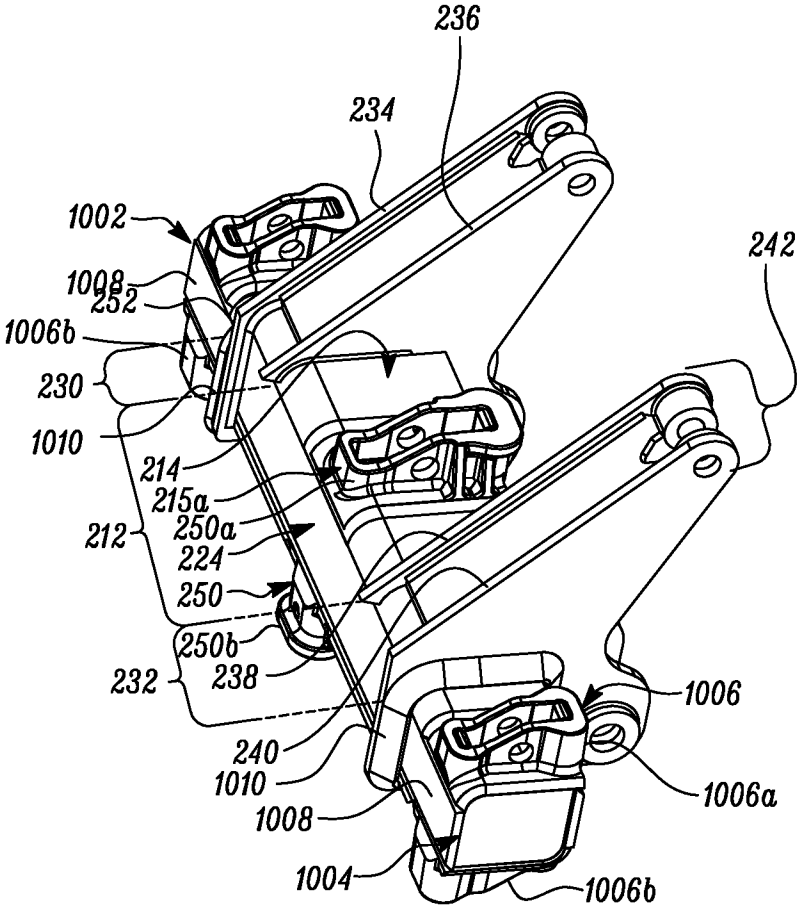
FIGS. 10*a* and 10*b* are exploded and assembled views of a secondary carriage configured for use in mounting multiple rippers, the views of FIGS. 10*a* and 10*b* showing a pair of end portions in accordance with embodiments of the present disclosure.
Figure 10A:
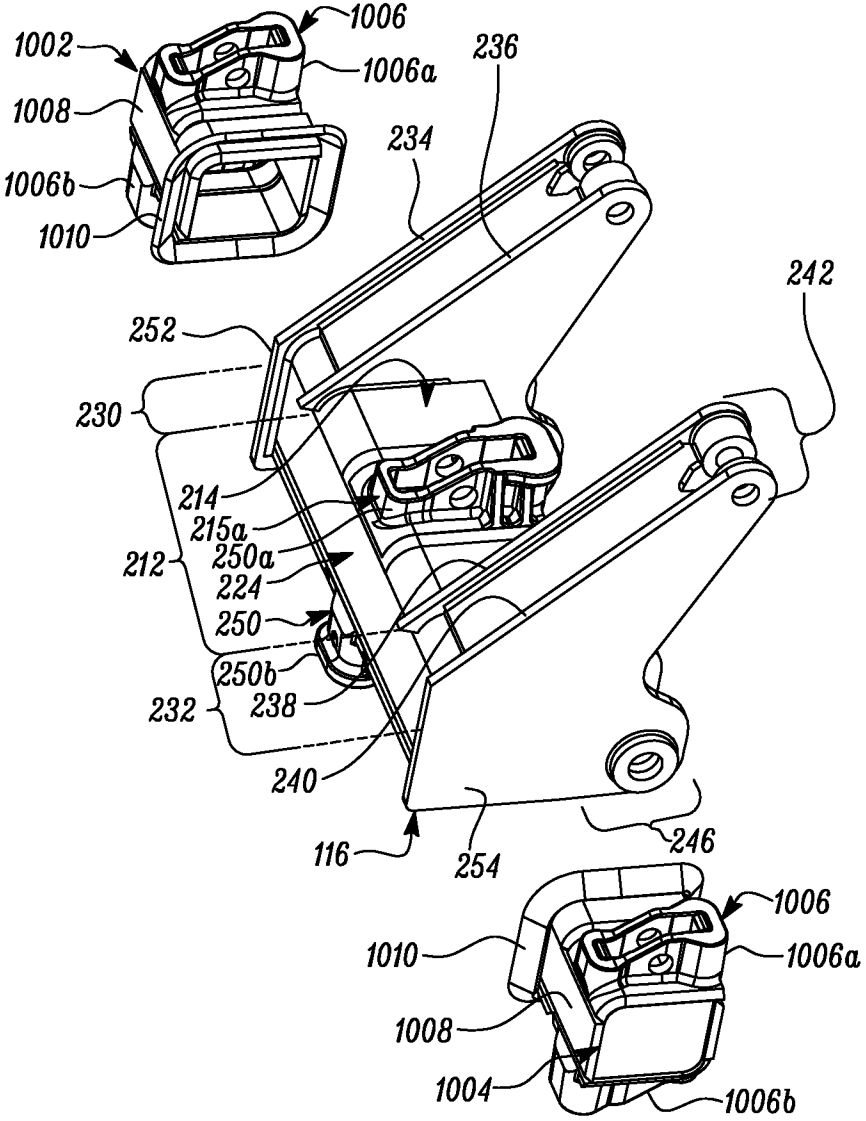
Figure 11:
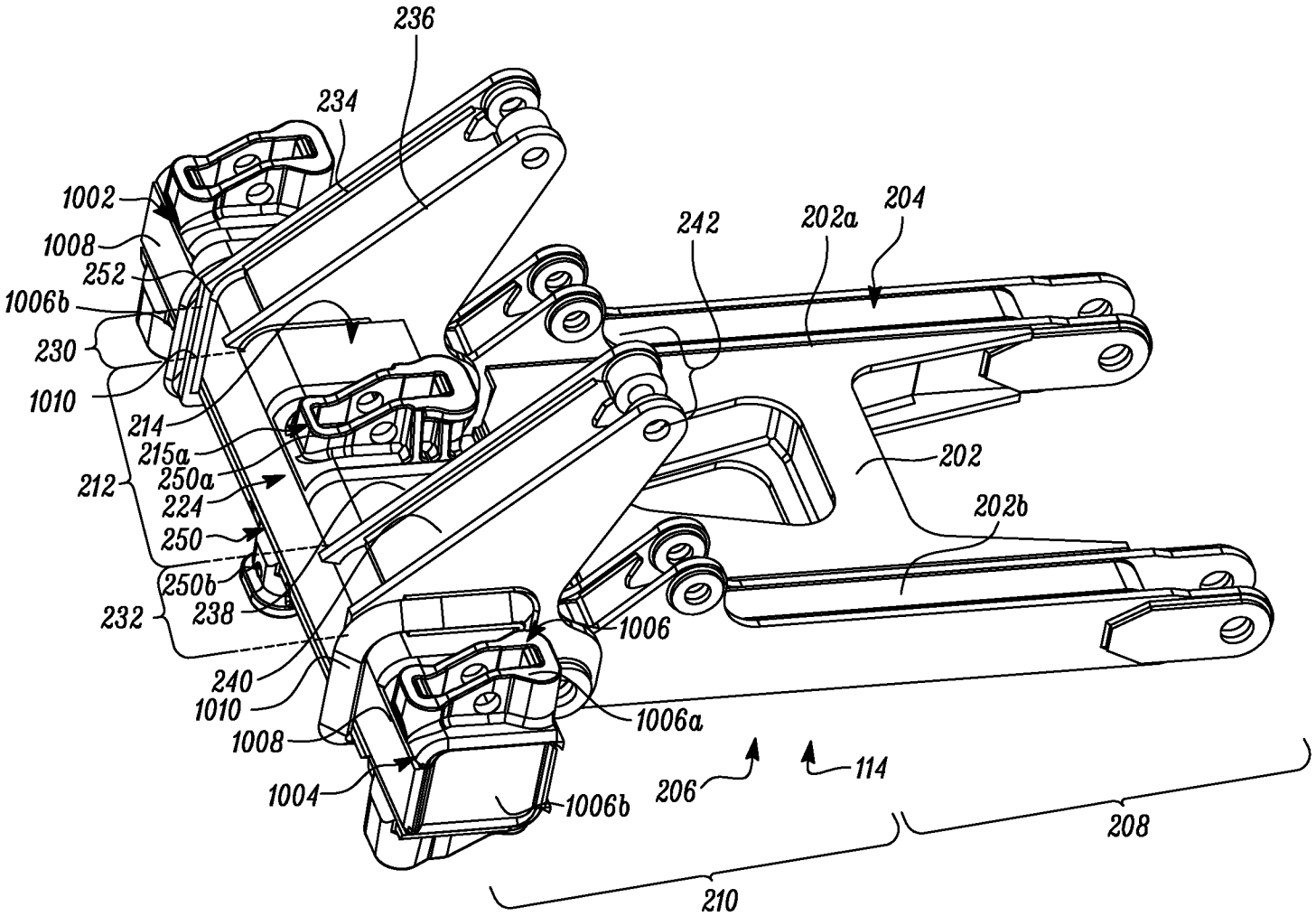
FIG. 11 is a rear perspective view of the ripper assembly showing the primary carriage and the secondary carriage, from FIG. 10*b*, that is configured for use in mounting multiple rippers in accordance with embodiments of the present disclosure.

It may be noted that in an embodiment as shown in FIG. 2 and FIGS. 4 through 9*b*, the mid-portion 212 and the pair of intermediary portions 230, 232 together define the secondary carriage 116 having a single shank holder 250 and hence, the secondary carriage 116 would be configured for use in defining a single ripper assembly that would facilitate mounting of a single ripper to the machine. However, in an additional embodiment as shown in FIGS. 10*a*, 10*b*, and 11, the secondary carriage 116 could further include a pair of end portions 1002, 1004 that may be attached to corresponding distal ends 252, 254 of the pair of intermediary portions 230, 232. As best shown in FIGS. 10*a* and 10*b*, each end portion 1002, 1004 could include another shank holder 1006 that would be secured by a pair of end plate sections 1008 welded onto distally located winged pivot brackets 234, 240 from the pair of intermediary portions 230, 232. Further, it may be noted that the shank holder 1006 could include a first portion 1006*a* and a second portion 1006*b* welded to the corresponding end plate section 1008.

Additionally, or optionally, in this embodiment, a support plate 1010 could be positioned between, and welded to, each end portion 1002, 1004 and the corresponding intermediary portion 230, 232 of the secondary carriage 116 respectively.

Various embodiments disclosed herein are to be taken in the illustrative and explanatory sense and should in no way be construed as limiting of the present disclosure. All joinder references (e.g., mounted, welded, coupled, attached, joined, connected and the like) are only used to aid the reader's understanding of the present disclosure, and may not create limitations, particularly as to the position, orientation, or use of the components disclosed herein. Therefore, joinder references, if any, are to be construed broadly. Moreover, such joinder references do not necessarily infer that two elements are directly connected to each other.

Additionally, all positional terms, such as, but not limited to, "fore", "aft", "first", "second", "primary", "secondary" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element relative to, or over, another element.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional components, such features may be omitted from the scope of the present disclosure without departing from the spirit of the present disclosure as defined in the appended claims.

INDUSTRIAL APPLICABILITY

The present disclosure has applicability for use in improving cost effectiveness in respect of value chain management at a metal working facility for producing the ripper assemblies 110 disclosed herein. The ripper assemblies 110 being produced using embodiments of the present disclosure allow for one ripper 122 to be installed at first. If desired at a subsequent time, the produced ripper assembly 110 can be adapted for use into a multiple ripper mounting configuration quickly and easily by merely attaching the pair of end portions 1002, 1004 to the secondary carriage 116 having the single ripper configuration disclosed herein. Moreover, a single configuration of the primary carriage 114 would be compatible for fitment with the secondary carriage 116 regardless of the configuration of the ripper assembly 110 i.e., single and multiple ripper mounting configuration.

Further, in embodiments of this disclosure, it may be noted that the shank holder 250 associated with the mid-portion 212 and the shank holders 1006 associated with the end portions 1002, 1004 may be similar or dissimilar in configuration. This facilitates mounting of similar or dissimilar configurations of ripper shanks and provides flexibility to users desirous of using a multiple ripper mounting assembly in customizing the configuration of each ripper to suit specific requirements of a ripping application.

With a reduced number of process steps 302-310 for the two types of ripper assemblies 110 disclosed herein i.e., single and multiple ripper assembly configurations, and by rendering the process steps 302-310 common between the single and multiple ripper assembly configurations, the present disclosure allows manufactures of the ripper assemblies 110 disclosed herein to offset additional costs that were typically incurred in installing and operating separate process lines that were previously used for distinctly producing conventional designs of single and multiple ripper mounting arrangements on the separate process lines. Further, use of the present disclosure can also help manufacturers reduce an amount of lead time required for producing the multiple ripper mounting assembly as the single ripper mounting assembly could now be produced beforehand, moved to inventory, and used when needed in the production of the multiple ripper mounting assembly.

Moreover, as process steps 302-310 are organized in a logical sequence for producing various weldments of the ripper assembly 110, or portions thereof, the ripper assembly 110 of the present disclosure can be produced in a relatively quick, easy, and cost-effective manner as opposed to conventional methods that have been known to persons skilled in the art.

While aspects of the present disclosure have been particularly shown and described with reference to the embodiments above, it will be understood by those skilled in the art that various additional embodiments may be contemplated by the modification of the disclosed machines, systems, methods and processes without departing from the spirit and scope of what is disclosed. Such embodiments should be understood to fall within the scope of the present disclosure as determined based upon the claims and any equivalents thereof.

What is claimed is:

1. A ripper assembly for a machine, the ripper assembly comprising:

a primary carriage formed using a pair of pivot arms disposed on either side of a mid-plane, each pivot arm having a fore portion configured to pivotally couple with a frame of a machine and an aft portion defining a mounting hole therein; and a secondary carriage having a mid-portion, and a pair of intermediary portions welded to ends of the mid-portion, wherein each intermediary portion is formed using a pair of winged pivot brackets having upper portions and lower portions, and wherein the secondary carriage is coupled to the frame by pivotally coupling the upper portion of at least one winged pivot bracket from each intermediary portion with the frame and to the primary carriage by pivotally coupling the lower portion of at least one winged pivot bracket from each intermediary portion with the mounting hole located at the aft portion of the corresponding pivot arm.

2. The ripper assembly of claim 1, wherein the primary carriage includes:

a winged support structure, and the pair of pivot arms welded onto corresponding sides of the winged support structure.

3. The ripper assembly of claim 2, wherein the secondary carriage includes:

the mid-portion formed by:

a first L-shaped cover module fabricated:

using two sets of three mutually perpendicular walls each, and a common carrier plate configured to extend from one of the three mutually perpendicular walls of each set, and arranging a pair of mutually opposing walls from corresponding sets on either side of the mid-plane located between the pair of pivot arms of the primary carriage; and positioning the pair of mutually opposing walls from corresponding sets in a spaced apart manner from each other to define a first gap together with the common carrier plate; and forming a second L-shaped cover module such that the second L-shaped cover module has a pair of mutually perpendicular walls and at least one of the walls defines a second gap in alignment with the first gap of the first L-shaped cover module;

welding the second L-shaped cover module with the first L-shaped cover module; and positioning a shank holder in alignment with the first and second gaps such that first and second portions of the shank holder are welded to the first and second L-shaped cover modules respectively;

fabricating the pair of intermediary portions using the pair of winged pivot brackets having upper portions and lower portions for pivotally coupling with the frame and the aft portion of the corresponding pivot arm respectively; and welding each intermediary portion to a corresponding end of the mid-portion.

4. The ripper assembly of claim 3, wherein proximal winged pivot brackets from the pair of intermediary portions define a cut-out that corresponds to a cross-section of the first and second L-shaped cover modules.

5. The ripper assembly of claim 4, wherein the mid-portion and the pair of intermediary portions together define the secondary carriage for a single ripper assembly.

6. The ripper assembly of claim 5, wherein the secondary carriage further includes a pair of end portions attached to distal ends of the pair of intermediary portions.

7. The ripper assembly of claim 6, wherein each end portion includes another shank holder that is secured by a pair of end plate sections welded onto distally located winged pivot brackets from the pair of intermediary portions.

8. The ripper assembly of claim 7 further comprising a support plate welded between each end portion and a corresponding intermediary portion of the secondary carriage.

9. The ripper assembly of claim 6, wherein the mid-portion, the pair of intermediary portions, and corresponding pairs of end portions together define the secondary carriage for a multi-ripper assembly.

10. A method for manufacturing a ripper assembly, the method comprising:

forming a primary carriage using a pair of pivot arms disposed on either side of a mid-plane, each pivot arm having a fore portion configured to pivotally couple with a frame of a machine and an aft portion defining a mounting hole therein;

forming a secondary carriage having a mid-portion, and a pair of intermediary portions welded to ends of the mid-portion, wherein each intermediary portion is formed using a pair of winged pivot brackets having upper portions and lower portions; and coupling the secondary carriage to the frame by pivotally coupling the upper portion of at least one winged pivot bracket from each intermediary portion with the frame and to the primary carriage by pivotally coupling the lower portion of at least one winged pivot bracket from each intermediary portion with the mounting hole located at the aft portion of the corresponding pivot arm.

11. The method of claim 10, wherein forming the primary carriage includes:

fabricating a winged support structure, and welding the pair of pivot arms onto corresponding sides of the winged support structure.

12. The method of claim 11, wherein forming the secondary carriage includes:

fabricating the mid-portion by:

using a first L-shaped cover module formed by:

using two sets of three mutually perpendicular walls each, and a common carrier plate configured to extend from one of the three mutually perpendicular walls of each set, and arranging a pair of mutually opposing walls from corresponding sets on either side of the mid-plane located between the pair of pivot arms of the primary carriage; and positioning the pair of mutually opposing walls from corresponding sets in a spaced apart manner from each other to define a first gap together with the common carrier plate; and forming a second L-shaped cover module such that the second L-shaped cover module has a pair of mutually perpendicular walls and at least one of the walls defines a second gap in alignment with the first gap of the first L-shaped cover module;

welding the second L-shaped cover module with the first L-shaped cover module; and positioning a shank holder in alignment with the first and second gaps such that first and second portions of the shank holder are welded to the first and second L-shaped cover modules respectively;

fabricating the pair of intermediary portions using the pair of winged pivot brackets having upper portions and lower portions for pivotally coupling with the frame and the aft portion of the corresponding pivot arm respectively; and welding each intermediary portion to a corresponding end of the mid-portion.

13. The method of claim 12 further comprising defining cut-outs in proximal winged pivot brackets from the pair of intermediary portions to correspond with a cross-section of the first and second L-shaped cover modules.

14. The method of claim 13, wherein the mid-portion and the pair of intermediary portions together define the secondary carriage for a single ripper assembly.

15. The method of claim 14 further comprising attaching a pair of end portions to distal ends of the pair of intermediary portions.

16. The method of claim 15 further comprising providing another shank holder to each end portion such that the other shank holder is secured by a pair of end plate sections welded onto distally located winged pivot brackets from the pair of intermediary portions.

17. The method of claim 16 further comprising a support plate welded between each end portion and a corresponding intermediary portion of the secondary carriage.

18. The method of claim 15, wherein the mid-portion, the pair of intermediary portions, and corresponding pairs of end portions together define the secondary carriage for a multi-ripper assembly.

* * * * *